United States Patent [19]

Eversole

[11] Patent Number: 4,523,327

[45] Date of Patent: Jun. 11, 1985

[54] MULTI-COLOR X-RAY LINE SOURCE

[75] Inventor: Jay D. Eversole, Lancaster, Calif.

[73] Assignee: The United States of America as represented by the Secretary of the Air Force, Washington, D.C.

[21] Appl. No.: 455,674

[22] Filed: Jan. 5, 1983

[51] Int. Cl.[3] ..... H01J 35/04

[52] U.S. Cl. ..... 378/124; 378/144

[58] Field of Search ..... 378/124, 144

[56] References Cited

U.S. PATENT DOCUMENTS

| | | | |
|---|---|---|---|
| 2,998,524 | 8/1961 | Friedman | 250/86 |
| 3,229,089 | 1/1966 | Sasao | 378/144 |
| 3,836,805 | 9/1974 | Kok | 378/144 |
| 3,934,164 | 1/1976 | Braun et al. | 313/60 |
| 4,007,375 | 2/1977 | Albert | 250/404 |
| 4,075,526 | 2/1978 | Grubis | 378/124 |
| 4,227,112 | 10/1980 | Waugh et al. | 313/41 |
| 4,433,431 | 2/1984 | Pfeiler | 378/124 |

*Primary Examiner*—Craig E. Church

*Attorney, Agent, or Firm*—Donald J. Singer; Bernard E. Franz

[57] ABSTRACT

An anode target comprises a copper block having different elemental target materials bonded to segments of the circumference, which rotate past the electron emitting cathode, to provide different emission lines in sequence. Aluminum and silicon target materials produce lines which bracket the aluminum absorption edge, to detect small amounts of aluminum in the presence of other absorbing materials by differential absorption of these two lines. Silver and rhodium may be used to bracket the chlorine absorption edge.

17 Claims, 4 Drawing Figures

MULTI-COLOR X-RAY LINE SOURCE

RIGHTS OF THE GOVERNMENT

The invention described herein may be manufactured and used by or for the Government of the United States for all governmental purposes without the payment of any royalty.

BACKGROUND OF THE INVENTION

This invention relates generally to X-ray generating apparatus, and more particularly to an X-ray tube having a target anode structure which produces a spectrum having line emission at different wavelengths.

The ability to produce specific atomic emission line spectra would provide a unique capability in X-ray analysis. Current technology uses a broad high energy spectrum of X-rays to perform analyses of materials by absorption. The degree of absorption is dependent on the total mass thickness in the X-ray beam, and specificity to the constituent absorbers is lost. However, with the appropriately chosen atomic emission lines in the source spectrum, it would be possible to detect small quantities of a particular element or elements in the presence of large quantities of other absorbers. In general the technique can be applied to any situation in which the concentration and/or spatial distribution of specific elements is required in the presence of other materials. One application of a multi-color X-ray line source would be two-phase flow diagnostics, such as analysis for solid particles including a particular element in a gas stream.

The prior art includes some United States patents showing monochromatic and multi-color X-ray sources, which describe various uses for medical diagnosis, industrial diagnosis of structures, and others. Friedman U.S. Pat. No. 2,998,524 discloses a monochromatic X-ray source including a copper base and a layer of aluminum, which produces only the line radiation, free of the continuum of energy values commonly called Bremsstrahlung or white radiation. Braun et al U.S. Pat. No. 3,943,164 discloses an X-ray tube with an anode target shaped like a disc open toward an electron emitting cathode. Rod-like members are disposed in an annular groove around the anode and provide substantially monochromatic X-radiation when bombarded with electrons. The rod-like target members in different arcuate portions are made of different materials and therefore emit radiation of different wavelengths in sequence as the anode rotates, thus providing a multi-color X-ray line source. Albert U.S. Pat. No. 4,007,375 discloses a multi-color X-ray source in a cathode-ray-type tube shown with four targets on the face of the tube, so that beam deflection can be used to select any one of the targets. Waugh et al U.S. Pat. No. 4,227,112 is of interest for its disclosure of a rotatable X-ray target having an annular focal track with a controlled gradient of target material.

SUMMARY OF THE INVENTION

An object of the invention is to provide an improved multi-color X-ray line source, suitable for detection of small amounts of a particular element in the presence of other absorbing materials by differential absorption of two lines, and for other uses.

The invention is incorporated in an X-ray generator of the type having a rotating cylindrical anode. The anode is coated with different target materials on separate portions of its circumference. In one example, the anode is a copper block, and the target materials are separate strips of aluminum and silicon, each extending half-way around the perimeter of the anode. The silicon and aluminum emission lines can be used to detect small amounts of aluminum in the presence of other materials by differential absorption of these two lines.

An advantage of this generator design is that it provides a source of various atomic X-ray emission lines which can be specified during fabrication or manufacture.

DETAILED DESCRIPTION

One particular purpose of the X-ray generator is to analyze a two-phase (gas and solid particulate) flow of material containing compounds of aluminum and chlorine. Since X-rays predominantly interact on an atomic level, the kind of information that might result from an X-ray diagnostic measurement is atomic species concentration (or density). One form of measurement uses a differential absorption technique.

X-ray generators operate on the basic principle of accelerating electrons from a filament into an anode or "target". X-radiation is given off by the electrons as they abruptly accelerate on impact with the target. Such radiation has a continuum of energy values (wavelengths) and is commonly called Bremsstrahlung. In addition, the impacting electrons collide with and eject other electrons in the atoms of the anode or target material. When an atom loses an inner shell electron, it may radiate a characteristic X-ray to restore its equilibrium. Thus, a typical generator gives off both a continuum spectrum and a discrete line spectrum, with the position of the lines being a function of the target or anode material.

The relative proportions of the continuum and line emission also depend on the target material but depend equally on the absolute energy position of the lines, the accelerating voltage and current of the electron beam, and the angular position of the detector relative to the target and electron beam. The largest commercially stocked generators employ a rotating, water-cooled anode to handle the waste heat which is also generated. A rotating anode system also has the advantage that its vacuum is maintained with pumps and thus could be disassembled for modifications. A current review of the history and design of high-intensity X-ray generators is found in Yoshimatsu, M. and Kozaki, S., "High Brilliance X-ray Sources", in X-ray Optics, *Topics in Applied Physics, Vol.* 22, Springer, N.Y., 1977.

Figure 1:
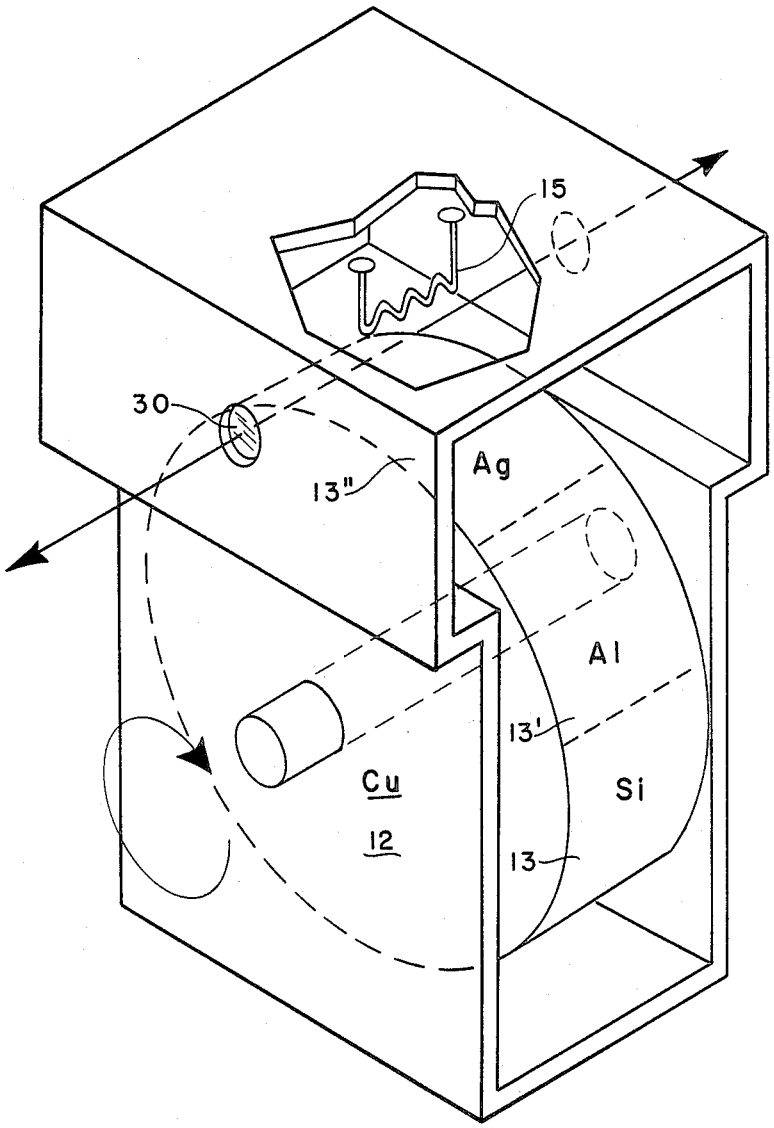
FIG. 1 is a symbolic diagram of a rotating anode X-ray generator.

After various approaches and possibilities were analyzed, it was conceived that appropriate emission lines could be generated to bracket the aluminum and chlorine absorption edges by coating the surface of the anode with appropriate materials. FIG. 1 is a schematic of an X-ray generator with a rotating anode 12 on which different segments 13, 13', 13" of the anode surface are coated with different target materials. X-rays are produced when electrons given off from the heated filament 15 collide with these target materials. As different target materials are rotated opposite the filament, the characteristic X-ray emission lines for that material are produced.

To demonstrate the measurement technique, it was sufficient to consider detection of aluminum only. If a successful measurement could be made of Al, the measurement of Cl would automatically be feasible and probably easier, since its K-edge is higher in energy than the Al K-edge. Therefore, the development effort has centered on producing two emission lines to bracket the Al K-edge at 1.55 keV. The higher energy line has been produced by silicon $K_\alpha$ emission at 1.74 keV, while the lower line is, not surprisingly, most conveniently produced by Al $K_\alpha$ emission at 1.49 keV. It is sometimes a point of confusion that Al is used as a target in the generator to produce Al $K_\alpha$ radiation which is then used to detect the amount of Al in an absorber. However, considering the shell model of atomic structure, it should be obvious that the onset of an absorption edge (inner shell ionization potential) will always be of a slightly higher energy than the outer-to-inner shell transition which follows and gives rise to the characteristic emission spectra. A source for chlorine would also include target materials such as silver for the $L_\alpha$ line at 2.98 keV, and rhodium for the $L_\alpha$ line at 2.69 keV, for bracketing the Cl absorption edge at 2.82 keV. Depending on the relative intensities, it might be possible to use the rhodium $L_\alpha$ line at 2.83 keV instead of the silver line.

The basic design of the anodes developed for these experiments used a standard copper anode (provided with the RU-200 commercial unit from Rigaku, USA, 3 Electronics Avenue, Danvers, Mass. 01923) as a substrate and coated its circumference half-way around with silicon and the other half with aluminum. The first attempts at fabricating anodes used thin-film deposition techniques to coat the anode with silicon and aluminum. Although these anodes were successful in the sense that they produced the desired spectra, their lifetimes were quite short. Even thick depositions of up to 100 nm were eroded by the electron beam from the filament. For high-beam currents of 60–100 milliamperes, the anode life could be as short as an hour. This type of anode was not satisfactory because of its low time and cost effectiveness and, more important, because its spectral output could be significantly changing in time as the surface material eroded.

Therefore, a different fabrication technique, plasma spraying (A. T. Shepard and H. S. Ingham, *Metco Handbook, Vol.* 2: *Powder Process,* Metco, Inc., Long Island, N.Y., 1965) was tried. Briefly, this method uses a gas jet (usually argon) to force particulate material through an electric arc and onto the surface of the work piece. Gas temperatures in the plasma arc may exceed 10,000° C., making the particles molten when they impact the surface. However, the heat transfer to the work piece is quite low, with its temperature remaining well below 100° C. The bond between the work piece and the sprayed material is reasonably good, allowing for light machining and polishing.

For an X-ray anode, the rough sprayed surface must be ground down to specified dimensions and polished. This technique had the advantages that a very thick coating could be built up (millimeters if necessary) and that a wide range of materials can be applied. In any event, anodes fabricated this way with 2-mm-thick coatings of Al and Si have operated intermittently for tens of hours with no apparent degradation.

Figure 2:
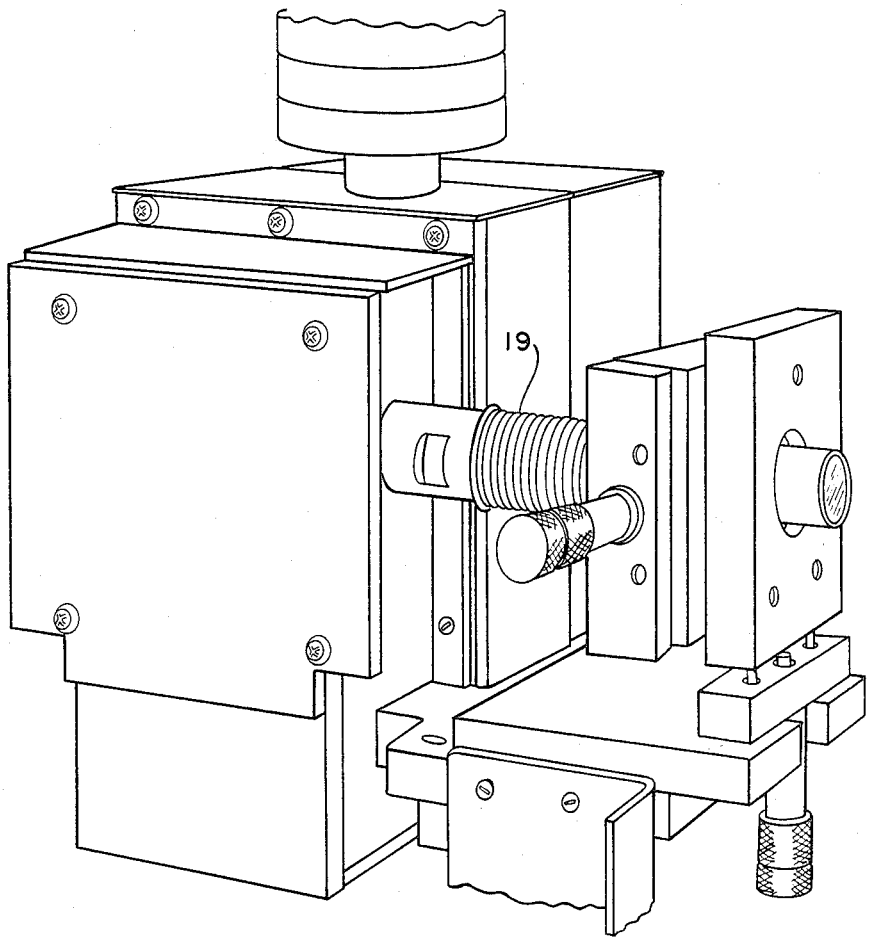
FIG. 2 is a perspective view from a photograph of an assembled X-ray generator head showing a modified window.

Three other modifications made to the commercial X-ray generator have a crucial bearing on the production of soft X-rays and are worth mentioning. First, the original beryllium window 30 was too thick. At 1.5 keV, Be has a reciprocal path length of 0.031 mm. The thinnest Be foils that were readily available commercially were 0.025 mm. For such foils, it was necessary to reduce the window aperture for mechanical support against atmospheric pressure into the evacuated generator. The reduced aperture (3 mm) does not compromise the beam size; however, it does create a problem with the take-off angle of the X-ray beam. "Take-off" angle refers to the angle between the tangent plane of the target (anode) opposite the filament and X-ray beam axis. X-rays are produced at all angles in the generator, but the greatest intensity of X-rays will be obtained in the plane containing the filament line which is perpendicular to the surface anode; that is, in the plane defined by the electron beam width. The source image becomes smaller, and hence the source brilliance higher, as the take-off angle is reduced, but as the take-off angle approaches zero there is a problem of X-rays being reabsorbed by the anode itself. For high-energy X-rays this problem is not significant, but for energies near 1.5 keV, optimal take-off angles may be between 5 and 10 degrees. Therefore, some ability to manipulate the window aperture or adjust the take-off angle was required. This problem was met by attaching the new window to the existing window port via a flexible welded metal bellows 19. FIG. 2 shows the modified window assembly supported with x-y micrometer stages for easy take-off angle adjustment. This arrangement has the added advantage of extending the window closer to the experiment, reducing the path length through air that the X-rays must travel.

Absorption of the soft X-ray emission lines on the anode surface proved to be a significant problem. Even small amounts of contamination on the surface of the anode can significantly reduce the intensity of soft X-rays. Two attempts were made to overcome this problem by improving on the vacuum capability of the generator. Commercial generators can run with pressures greater than $1\times10^{-6}$ kPa and operate at around 60 kV; higher energy radiation is unaffected by light carbon deposit or other surface contamination on the anode. (Ironically, the higher acceleration voltage may act to keep the anode surface clean.) Independent study, by Konuma, H., "Rate of Carbon Contamination of Al Targets in a High Vacuum Electron Excitation X-Ray Turb," Japan J. Appl. Phys 18 (2), 1979 357–362, indicated that pressures less than $1\times10^{-7}$ kPa were necessary to maintain high output at the $AlK_{60}$ emission line.

Initially it was assumed that the major source of residual gasses was outgassing off the large interior surface of the generator. With this premise an ion pump and liquid $N_2$ cold trap were ported directly to the anode chamber, with the idea of valving off the existing diffusion and roughing pump once the chamber pressure was in the $10^{-6}$ kPa range. However, the 20 liter/-sec ion pump proved to be sufficient to maintain any improved vacuum pressure. Subsequently, it was discovered that relatively large amounts of oil were being introduced to the ion chamber via the rotatable feedthrough for the anode shaft which had a circulating oil seal. The seal worked, as helium leak checking demonstrated, but the vapor pressure of the oil itself was a contamination source.

At this time the best option appeared to be to use available equipment and approach the problem with brute force. An 18-cm nominal diameter diffusion pump with liquid nitrogen cold trap was installed in place of the original 8-cm nominal diameter diffusion pump. With this arrangement, pressures in the range of $10^{-9}$ kPa were measured at the pump inlet. Chamber pressures of about $10^{-7}$ kPa were obtained in the generator during operation. Ultimately, this measure may have improved operation of the generator, but it did not solve the problem. Part of the difficulty may have been the long distance between the anode head and the diffusion pump. In hindsight, the anode head should have been reconfigured to mount directly on the pump inlet.

The continuing problem of carbon deposition from the anode vacuum seal led eventually to the third and last major modification of the X-ray generator. Since the seal itself seemed to be the source of contamination, alternative methods of vacuum sealing a shaft that rotates at about 2,000 rpm were surveyed. A relatively new product appeared to be the most promising (Ferrofluidics Corp., 40 Simon Street, Nashua, N.H. 03061). In its construction the vacuum seal is maintained between the body and the shaft by a series of fluid rings rather than a wide, continuous oil film. The fluid is a silicon-based suspension of fine iron particles which allow the fluid to be held in place around the shaft by permanent magnets mounted in the body. Experience indicates that the leak rate of this seal is at least as good as the original oil seal, and it completely eliminates the oil source of contamination.

Figure 3:
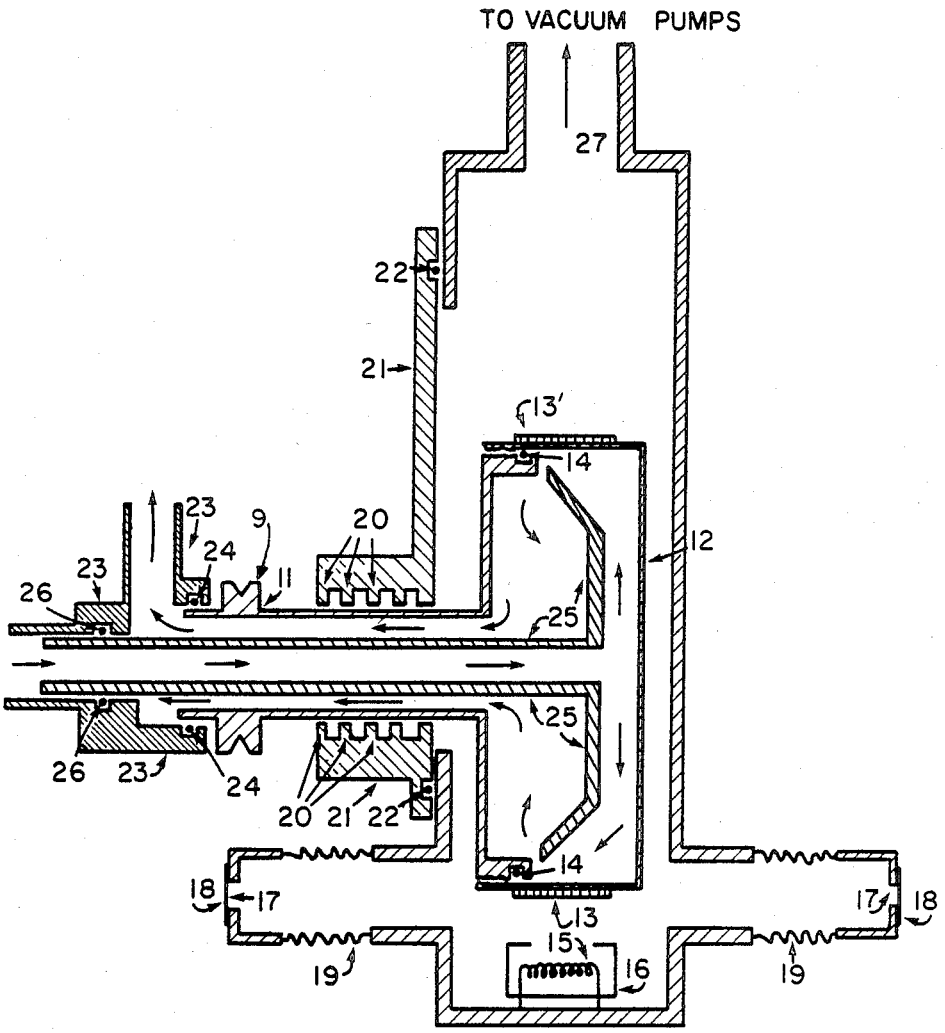
FIG. 3 is a cross section view of the anode and its mounting in the generator, showing how the shaft is sealed by a series of fluid rings held in place by permanent magnets.

A cross section view of the modified X-ray generator is shown in FIG. 3. This is a simplified symbolic view in some respects. For example, the two windows are represented as attached with bellows 19, but the x-y micrometer arrangement shown in FIG. 2 is not shown in FIG. 3.

An outer anode shaft 11 is driven by a V-belt (not shown) on a pulley 9 to rotate at about 2,000 rpm.

Copper anodes base 12 is attached to outer anode shaft 11 by screw threads and sealed by an O-ring 14.

Target materials 13,13' for characteristic X-ray generation are attached to anode base 12 by plasma spray technique previously described.

X-rays are generated when electrons given off by filament 15 and focussed by a deflection cup 16 are accelerated into target materials 13,13'. X-rays are then emitted through apertures 17 which are sealed with thin Beryllium foil 18 and connected to the X-ray head by flexible vacuum bellows 19.

Vacuum is maintained inside the X-ray head by vacuum pumps ported directly to the X-ray head 27. Sealing the rotating outer anode shaft 11 was achieved with magnetic fluid seals 20 and bearings mounted in a stationary flange 21. The flange 21 is attached to the X-ray head housing and sealed with O-rings 22 and is large enough to permit the complete removal of the anode.

Waste heat produced in the rotating anode is dissipated by water flowing continuously through the hollow anode interior. Water is introduced through a water-jacket housing 23 which is sealed to the outer rotating anode shaft 11 with an O-ring 24, and also to a stationary water deflector-shaft 25 with an O-ring 26. The water deflector-shaft 25 does not rotate, but is situated inside the anode and runs down the hollow outer anode shaft 11. Water flows down the interior of the water-deflector shaft 25, around its deflecting fins, cooling the anode base 12 and target materials 13,13'. The heated water then flows between the exterior of the water deflector-shaft 25 and the outer anode shaft 11 to be cooled in an external heat exchanger and be recirculated.

Figure 4:
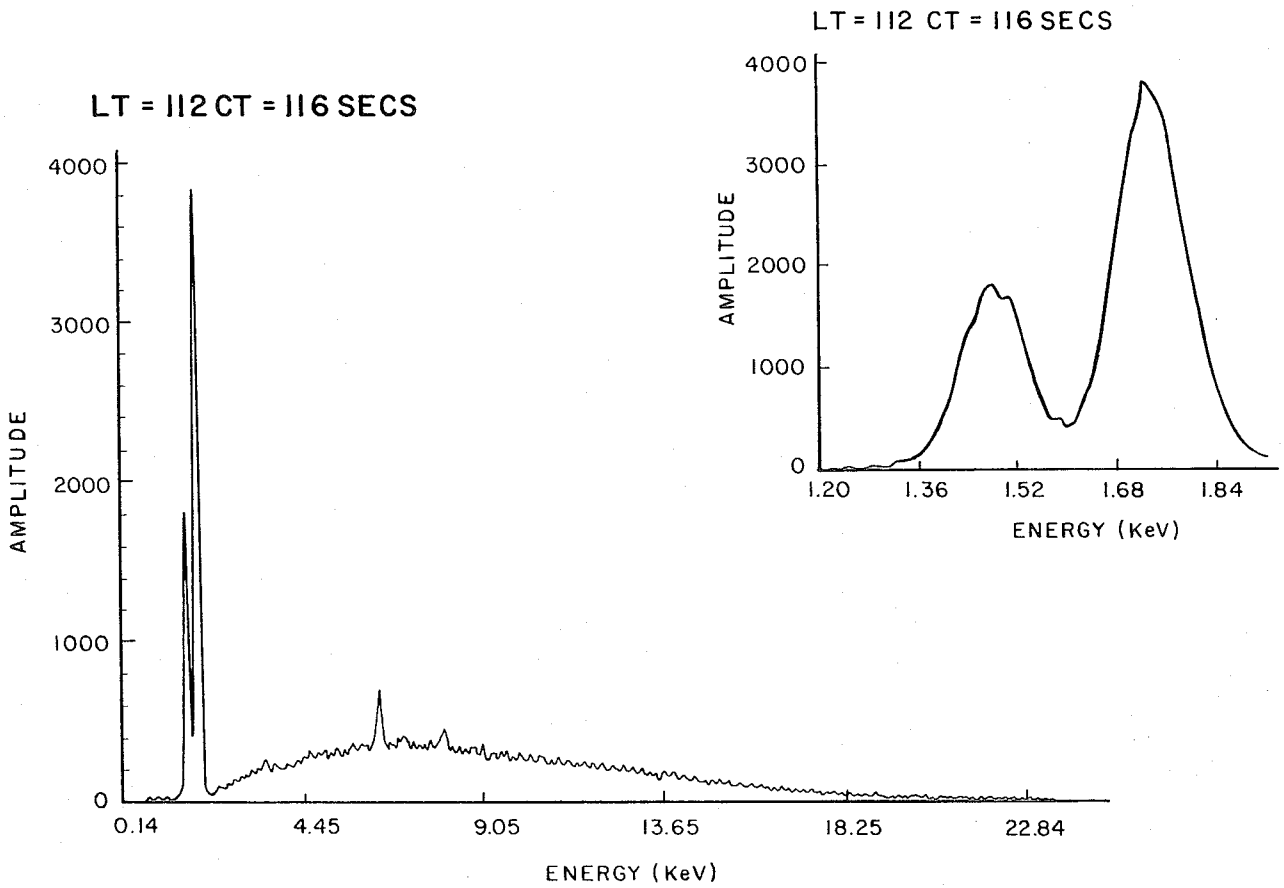
FIG. 4 is a graph showing the typical spectrum of the X-ray output from a generator with an anode target surface which has an aluminum segment and a silicon segment around the periphery.

In concluding this description of the development of a specialized X-ray source, FIG. 4 is a representative output spectrum from the generator at 20 kV and 10 mA taken in a helium atmosphere with a Si(Li) lithium drifted silicon detector and multichannel analyzer. (Absolute X-ray intensities are difficult to measure especially at high flux rates.) The two strong peaks at the left of the graph are Al $K_{60}$ and Si $K_{60}$ emission lines from the anode. Between these two lines lies the aluminum absorption edge. The smaller peaks at about 6.4 and 8.4 keV are emission lines from iron and copper which evidently are impurities present in the aluminum or silicon powder used to fabricate the anode. It is important to note that a direct spectrum must be apertured very narrowly and that the relative peak heights and background (Bremsstrahlung) intensity are all strong angular-dependent functions.

Thus, while preferred constructional features of the invention are embodied in the structure illustrated herein, it is to be understood that changes and variations may be made by the skilled in the art without departing from the spirit and scope of my invention.

I claim:

1. A multi-target X-ray source comprising:

an envelope;

an anode rotatably supported within the envelope and having an annular target portion;

an electron emitting cathode supported within the envelope in spaced relationship with the target portion;

the target portion being comprised of a plurality of segments of different target materials of a substantially uniform thickness, with the target material of each segment being an integral unit having a smooth continuous surface;

wherein said envelope includes a window of beryllilum which is very thin and has a small aperature, the window being attached to a port in said envelope by a flexible bellows and mounted to permit manipulation of the aperature to adjust the take off angle of the X-ray beam which passes through the window.

2. A multi-target X-ray source comprising:

an envelope;

an anode rotatably supported within the envelope and having an annular target portion;

an electron emitting cathode supported within the envelope in spaced relationship with the target portion;

the target portion being comprised of a plurality of segments of different target materials of a substantially uniform thickness, with the target material of each segment being an integral unit having a smooth continuous surface;

wherein said anode has a main cylindrical body in the form of a copper base, said target portion is on the outer circumference thereof; and the target material of each segment is substantially a single elemental material.

3. An X-ray source according to claim 2, wherein the target material of one segment is aluminum for producing Al $K_{60}$ emission at 1.49 keV, and the target material of another segment is silicon for producing Si $K_{60}$ emission at 1.74 keV, to bracket the aluminum absorption edge at 1.55 keV.

4. An X-ray source according to claim 3, wherein the segments include one of silver and one of rhodium to produce $L_{60}$ lines respectively at 2.98 keV and at 2.69 keV, for bracketing the chlorine absorption edge at 2.85 keV.

5. An X-ray source according to claim 2, wherein the segments include one of silver and one of rhodium to produce $L_{\alpha}$ lines respectively at 2.98 keV and at 2.69 keV, for bracketing the chlorine absorption edge at 2.85 keV.

6. An X-ray source according to claim 2, wherein the target material of each segment is attached to the copper base with bonding of the type produced by plasma spraying.

7. A multi-target X-ray source comprising:

an envelope;

an anode rotatably supported within the envelope and having an annular target portion;

an electron emitting cathode supported within the envelope in spaced relationship with the target portion;

the target portion being comprised of a plurality of segments of different target materials of a substantially uniform thickness, with the target material of each segment being an intgegral unit having a smooth continuous surface;

wherein said anode has a main cylindrical body, said target portion is on the outer circumference thereof, all points on the outer surface of the target portion being substantially equidistant from an axis of rotation for the anode, with the cathode at a greater radial distance from said axis than said outer surface, and window means forming part of said envelope located to pass an X-ray beam emitted from the target portion at a small take off angle in a range down to zero degrees to said outer surface.

8. An X-ray source according to claim 7, wherein said window means has a small aperature, and means which permits manipulation of the aperature to adjust said take off angle of the X-ray beam passing through the aperature.

9. A multi-target X-ray source comprising:

an envelope;

an anode rotatably supported within the envelope and having an annular target portion;

an electron emitting cathode supported within the envelope in spaced relationship with the target portion;

the target portion being comprised of a plurality of segments of different target materials of a substantially uniform thickness, with the target material of each segment being an intgegral unit having a smooth continuous surface;

wherein said anode includes a base portion, and wherein the target material of each segment is attached to said base portion with bonding of the type produced by plasma spraying.

10. An X-ray source according to claim 9, wherein said base portion forms a cylindrical wall of a body which is hollow and has two end walls, with one end wall having a central hole and being attached to a hollow shaft which passes through said envelope via bearing means, so that the shaft may be rotatably driven outside the envelope to rotate the anode, said target portion being bonded to the outer surface of said base portion, and cooling means including a tube within said shaft and passing through said hole into said base portion for circulating a fluid via a path which includes the inside of said tube, the inside of said base portion and the inside part of said shaft which is outside the tube, and wherein said envelope is evacuated by continuous pumping during operation.

11. An X-ray source according to claim 10, wherein said envelope includes an opening having a removable cover means, which permits removal of the entire anode structure.

12. An X-ray source according to claim 10, wherein said base portion is formed of copper, and the target material of each segment is substantially a single elemental material.

13. An X-ray source according to claim 12, wherein the target material of one segment is aluminum for producing Al $K_{\alpha}$ emission at 1.49 keV, and the target material of another segment is silicon for producing Si $K_{60}$ emission at 1.74 keV, to bracket the aluminum absorption edge at 1.55 keV.

14. An X-ray source according to claim 13, wherein the segments include one of silver and one of rhodium to produce $L_{\alpha}$ lines respectively at 2.98 keV and at 2.69 keV, for bracketing the chlorine absorption edge at 2.85 keV.

15. An X-ray source according to claim 13, wherein said envelope includes a window of beryllium which is very thin and has a small aperture, the window being attached to a port in said envelope by a flexible bellows and mounted to permit manipulation of the aperature to adjust the take off angle of the X-ray beam which passes through the window.

16. An X-ray source according to claim 15, wherein said bearing means includes means to provide a seal maintained between the envelope and the shaft by a series of fluid rings, the fluid being a silicon-based suspension of fine iron particles held in place around the shaft by permanent magnets mounted in the envelope.

17. A multi-target X-ray souurce comprising:

an envelope;

an anode rotatably supported within the envelope and having an annular target portion;

an electron emitting cathode supported within the envelope in spaced relationship with the target portion;

the target portion being comprised of a plurality of segments of different target materials of a substantially uniform thickness, with the target material of each segment being an intgegral unit having a smooth continuous surface;

wherein said envelope is evacuated by continuous pumping during operation, the anode is mounted on a shaft passing through the envelope to the outside, with a seal maintained between the envelope and the shaft by a series of fluid rings, the fluid being a silicon-based suspension of fine iron particles held in place around the shaft by permanent magnets mounted in the envelope.

* * * * *

UNITED STATES PATENT AND TRADEMARK OFFICE

CERTIFICATE OF CORRECTION

PATENT NO. : 4,523,327

DATED : June 11, 1985

INVENTOR(S) : J.D. Eversole

It is certified that error appears in the above-identified patent and that said Letters Patent is hereby corrected as shown below:

At column 4, line 60, column 6, line 19, and in claims 3, 4 and 13, the subscript "60" should be the Greek letter alpha ($\alpha$).

At column 5, line 47, change "anodes" to -- anode --.

Signed and Sealed this

*Twelfth* Day of *November 1985*

[SEAL]

*Attest:*

DONALD J. QUIGG

*Attesting Officer*

*Commissioner of Patents and Trademarks*